United States Patent [19]

Updegrave et al.

[11] Patent Number: 4,483,637

[45] Date of Patent: Nov. 20, 1984

[54] BINDER FOR BUSINESS FORMS

[75] Inventors: William C. Updegrave, Fords, N.J.; Charles E. Jones, Evanston, Ill.; Jerome E. Froehlich, Midland, Mich.

[73] Assignee: Moore Business Forms, Inc., Grand Island, N.Y.

[21] Appl. No.: 393,318

[22] Filed: Jun. 29, 1982

[51] Int. Cl.[3] ..... B42F 13/02; B42F 15/00

[52] U.S. Cl. ..... 402/15; 402/17

[58] Field of Search ..... 281/42, 47; 402/78, 402/38, 503, 15, 39, 16, 17; 417/39

[56] References Cited

U.S. PATENT DOCUMENTS

| | | | |
|---|---|---|---|
| 849,836 | 4/1907 | Dow | 402/16 |
| 1,275,104 | 7/1918 | Taylor | 402/17 |
| 3,172,409 | 3/1965 | Goldman | 402/15 |
| 3,667,854 | 6/1972 | Jonas | 402/17 |
| 3,706,502 | 12/1972 | Fleur | 402/17 |
| 4,171,854 | 10/1979 | Hedstrom | 402/15 |

FOREIGN PATENT DOCUMENTS

| | | | |
|---|---|---|---|
| 1512416 | 2/1968 | France | 402/15 |
| 103261 | 1/1917 | United Kingdom | 402/16 |
| 968657 | 9/1964 | United Kingdom | 402/15 |

*Primary Examiner*—Robert L. Spruill
*Assistant Examiner*—Paul M. Heyrana, Sr.
*Attorney, Agent, or Firm*—Allegretti, Newitt, Witcoff & McAndrews, Ltd.

[57] ABSTRACT

A looseleaf binder assembly for securing and storing business forms such as computer printout business forms wherein apertures are usually provided in the forms. The assembly includes top and bottom cover members and a pair of elongated flexible securing members which are removably received by the cover members. The cover members and the securing members are constructed and arranged to removably secure the business forms in position between the cover members. The flexible elongated securing members pass through the apertures in the business forms. The cover members are both of the same structure and each is unitarily formed and includes a cover portion that covers and is superimposed over the stored business forms. Each of the cover members also includes a contiguous marginal edge portion which is unitary with the cover portion. Spaced openings are provided in each edge portion and each of the openings is in line with the apertures that are provided in the forms. The openings are constructed and arranged to receive the elongated and flexible securing members. Locking portions are defined on and unitary with the marginal edge portions and are spaced laterally of each opening in order to removably receive and secure a portion of the flexible securing member to the cover. The flexible securing members and the cover portions define the only operative parts needed to removably secure the forms in place between the cover members.

9 Claims, 9 Drawing Figures

Fig. 3
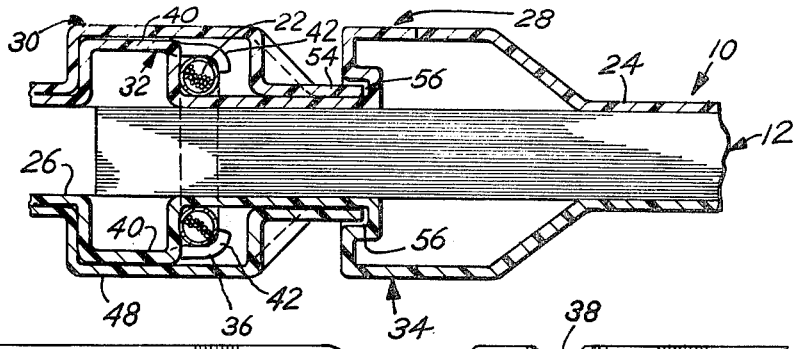
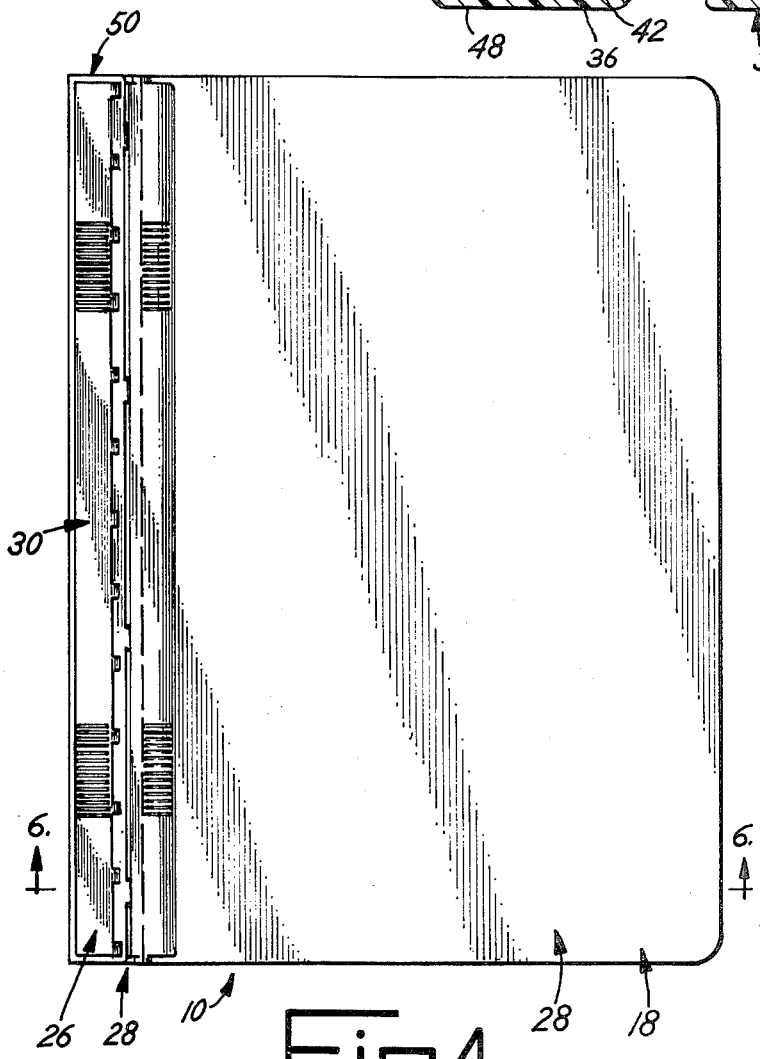
Fig. 4
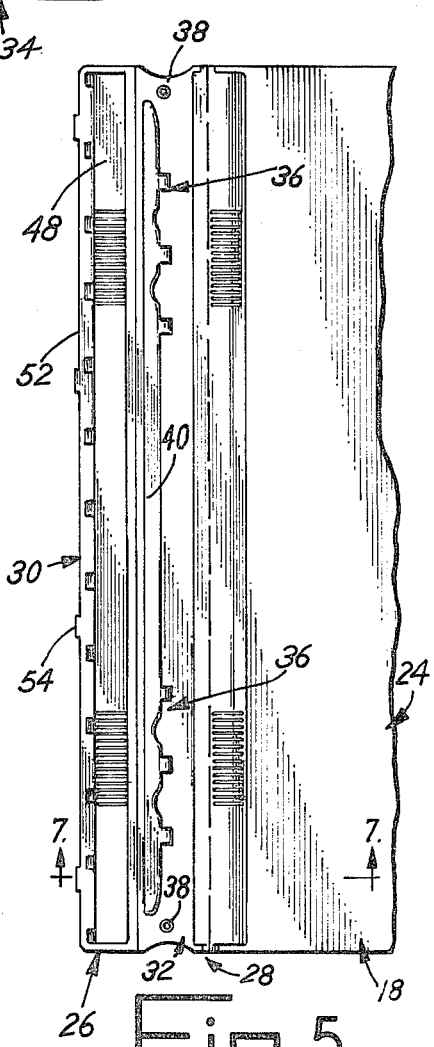
Fig. 5
Fig. 6
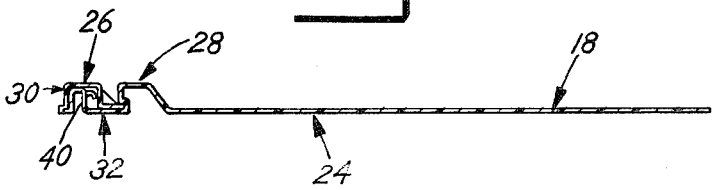
Fig. 7
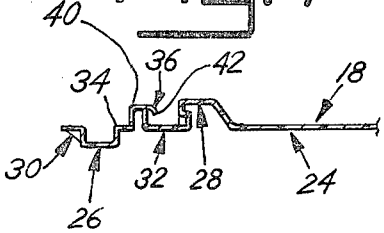

BINDER FOR BUSINESS FORMS

BACKGROUND OF THE INVENTION

Field of the Invention and Description of the Prior Art

This invention relates to binder assemblies for securing and storing information printed on business forms and the like and it particularly relates to post type looseleaf binders for business forms, particularly of the computer printout type.

Data binders or looseleaf binders have been known and used for many years. Specifically, data binders of the type sized to receive and store computer printout sheets containing printed information are very widely used and their use has generally been on the increase. Such looseleaf or data binders are generally of the post type. These known, prior art binders generally comprise top and bottom covers having posts for securing the top and bottom covers to each other with bound forms therebetween. The posts are of both the rigid and flexible types. Such prior art binders have been generally satisfactory in use, however, the known looseleaf type of post binders are of rather complex construction as they require various assembled elements, particularly for the post arrangements and the locking mechanisms. Such elements generally are of metal or plastic construction and must be assembled to the main body of the covers. The prior art looseleaf binders are shown, for example, in the Klein et al U.S. Pat. No. 3,078,853, Potts U.S. Pat. No. 3,150,667, Potts U.S. Pat. No. 3,224,449, Whittemore et al U.S. Pat. No. 3,224,450, Lindgren et al U.S. Pat. No. 3,263,689, Schade U.S. Pat. No. 3,582,224, Barnes, Jr. U.S. Pat. No. 3,628,877, and Rose U.S. Pat. No. 3,957,321. There is believed to be a significant need for simply and economically constructed in binder assemblies which are both durable and highly useful.

SUMMARY OF THE INVENTION

It is therefore a principal object of the present invention to provide a novel, post-type looseleaf data binder assembly particularly adapted to store data printed on computer printout sheets and the like wherein the binder assembly is particularly characterized by its simplicity, economy and durability of construction, and convenience in use.

It is also an object of the present invention to provide an improved data binder assembly for storing business forms of various types wherein the assembly requires only two basic elements, that is, a cover portion and a binder portion, two of the cover portions and two of the binder portions being used to form the data binder.

It is a further object of the present invention to provide a data binder assembly which includes a pair of data binder covers of the same construction and wherein the data binder cover is unitarily formed in a single manufacturing operation and is ready for use without the addition of parts so as to create an operative part.

It is still another object of the present invention to provide an improved data binder assembly having two cover portions which are unitarily formed by a thermo-forming operation and which require no further manufacturing steps after such thermo-forming operation.

It is also another object of the present invention to provide an improved data binder assembly utilizing flexible thermo-forming cover and post assemblies and no additional parts are added to either the cover assemblies or to the flexible post member.

It is still another object of the present invention to provide an improved cover for a data binder assembly wherein the cover is unitarily formed of polypropylene and includes a unitary hinge portion and a marginal edge portion which includes integral locking portions for securement of the cover to a flexible binder post.

Further purposes and objects of the present invention will appear as the specification proceeds.

The foregoing objects are accomplished by providing an improved binder assembly for securing and storing business forms of the type having apertures therein, the assembly including first and second cover members and first and second elongated flexible binding posts removably received by the first and second covers, the cover members and the binding posts being constructed and arranged to removably secure the business forms in position between the covers, the flexible binding posts passing through selected ones of the apertures in the business forms, each of the covers being unitarily formed and having a cover portion substantially covering and being superimposed over the secured stored business forms and also having a contiguous marginal edge portion unitary with the cover portion, spaced openings provided in the edge portion, each of the openings being substantially aligned with the apertures in the forms and being constructed and arranged to receive the elongated flexible binding posts, securing portions defined on and unitary with the marginal edge portion, each securing portion being spaced laterally of an aperture in the marginal edge portion for removably receiving and securing a portion of the flexible binding post, the flexible binding post and the covers defining the only operative parts required for removably securing the forms in place between the cover members.

BRIEF DESCRIPTION OF THE DRAWINGS

Particular embodiments of the present invention are illustrated in the accompanying drawings wherein:

FIG. 3 is an enlarged sectional view taken along line 3—3 illustrating the elements used for locking the binder post in place on the cover assembly;

FIG. 4 is a top plan view of a cover assembly using the data binder assembly of FIGS. 1–3;

FIG. 5 is a fragmentary top plan view of the cover illustrated in FIG. 4 having the locking section of the marginal edge portion of the cover moved to the open position;

FIG. 6 is a sectional view of the cover embodied in FIG. 4, taken along the line 6—6 of FIG. 4;

FIG. 7 is a sectional view of the marginal edge portion, in the open position, taken along line 7—7 of FIG. 5;

FIG. 8 is an alternate embodiment of the present invention made substantially in accordance with the data binder assembly of FIGS. 1–7 except including unitarily formed hook sections for hanging the binder assembly on support rods or the like.

DETAILED DESCRIPTION OF THE PREFERRED EMBODIMENT

Figure 1:
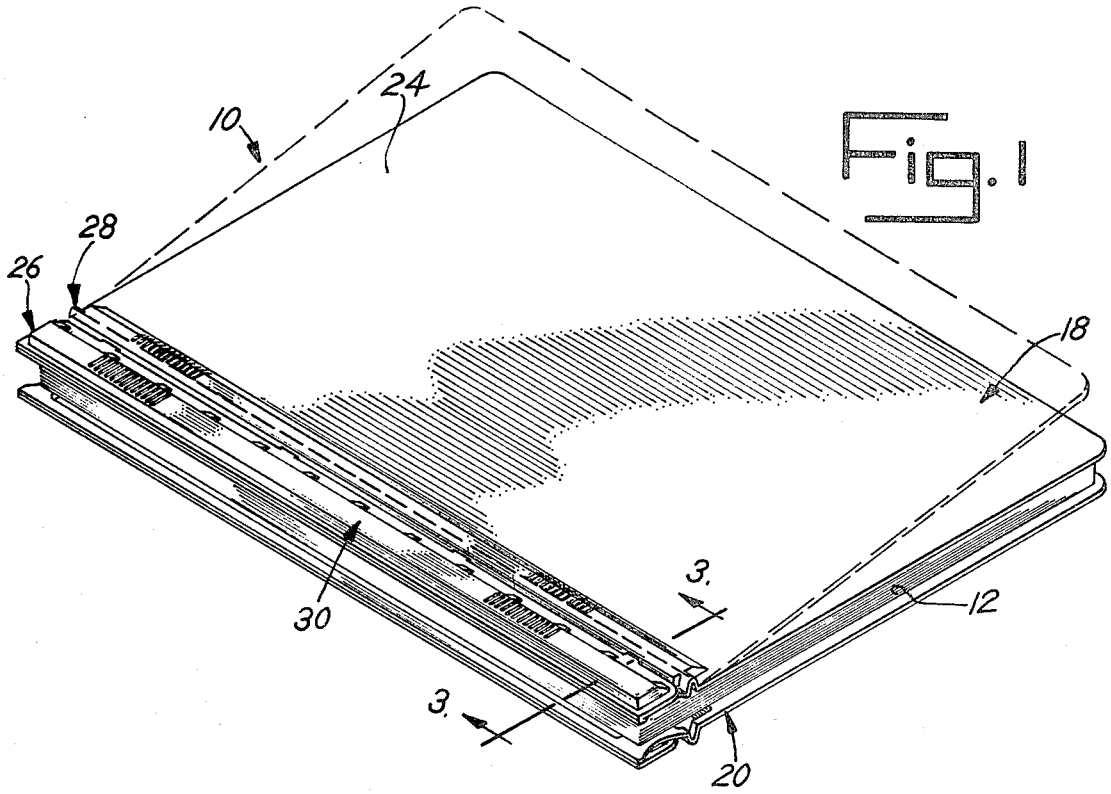
FIG. 1 is a pictorial view of a data binder assembly constructed in accordance with the present invention.
Figure 2:
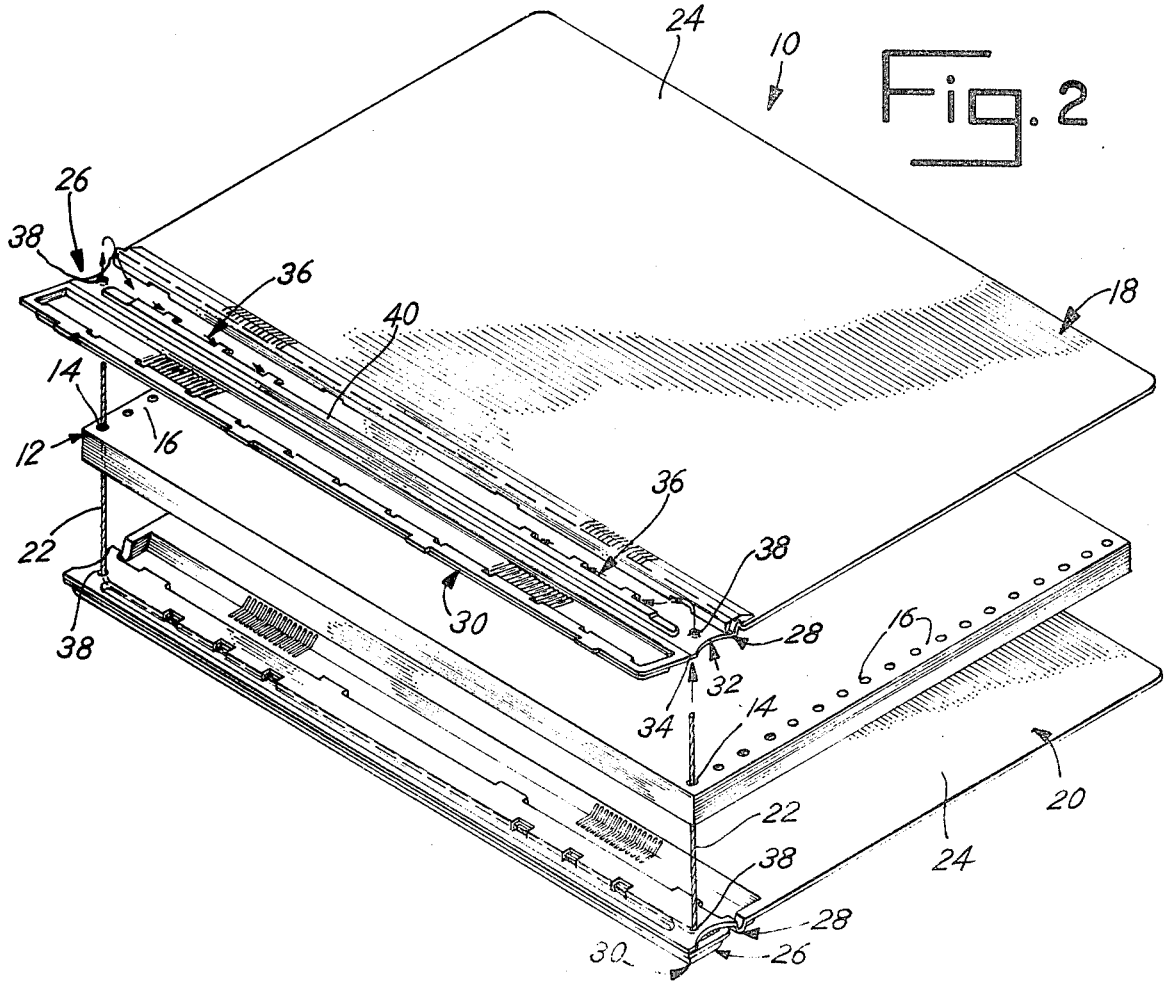
FIG. 2 is an exploded view of the data binder assembly, while being assembled, as shown in FIG. 1 illustrating both cover portions and both flexible binder posts which define the sole structural elements of the data binder assembly.

Referring to FIGS. 1 and 2, our improved looseleaf type data binder assembly, generally 10, is pictorally illustrated in both an assembled view and an exploded, open view, illustrating the manner of assembly. The assembly 10 secures and stores a collection of business forms, generally 12. Referring to FIG. 2, although a computer printout type of business form 12 is illustrated, it is to be understood that the looseleaf binder assembly 10 may be used for binding or securing and storing a wide variety of various types of business forms, although, generally, such forms include at lease a pair of apertures 14 on the corners along one edge thereof. As seen in FIG. 2, the form 12, as shown, is a computer printout type of business form and may include a plurality of feedholes 16 which are provided along opposite marginal edges of each of the forms 12. The apertures 14 each comprise one feed hole.

As best seen in FIG. 2, the binder assembly 10 generally includes a top cover, generally 18, a bottom cover, generally 20 and a pair of flexible binder posts 22 which are provided to secure the collection of business forms 12 in place between the covers 18 and 20. Both the top cover 18 and the bottom cover 20 have the same construction. Therefore, only one cover, such as the top cover 18, will generally be described hereinafter in detail.

Referring to FIGS. 4–7, in particular, each cover 18 or 20 includes a generally planar cover portion 24 which has substantially the same dimensional size as the surface area of the business form 12 so as to cover or be superimposed thereover. Each cover 18 or 20 also includes a marginal edge portion, generally 26 which is contiguous with and is hingedly connected to the cover portion 24 by a hinge portion, generally 28, which is contiguous with both the marginal edge portion 26 and the cover portion 24 and extends along the entire length of the cover 18 or 20. The cover 18 or 20 is constructed entirely of sheet plastic, preferably polypropylene of a known type, utilizing thermo-forming techniques. Polypropylene is known to have unique properties enabling there to be hinging action between adjacent parts of the same formed cover 18 or 20. This known property of polypropylene provides a "living hinge" which provides the desired hinging action between the cover portion 24 and the marginal edge portion 26 of each cover 18 or 20 in order to conveniently open and close the coves 18 or 20 along the hinge portion 28. The thermo-forming techniques employed to manufacture the cover provides for great simplicity and economy in manufacturing each cover 18 or 20, particularly since no further manufacturing steps are required following the thermo-forming operation employed during manufacture. As will be described, all required operating parts of each cover 18 or 20 are formed in the same operation, that is, during the thermo-forming operation.

Referring again to FIGS. 4–7, each marginal edge portion 26 of the cover 18 or 20 includes an outer section, generally 30, and an intermediate section, generally 32, which is hingedly secured to the cover section 30 along a hinge section 34. The intermediate section 32 includes a pair of unitary locking sections 36, each of which is spaced inwardly from the opposite outer ends of the intermediate section 32. Each of the locking sections 36 is also spaced from the other along the length of the intermediate marginal section 32. An opening 38 is located at the outer end portion of each end of the intermediate section of the marginal edge portion 26. Each opening 38 extends laterally away from the locking section 36. As seen best in FIG. 2, each opening 38 is sized and constructed and arranged to be in general alignment with one of the form apertures 14 provided in the corners of the stored forms 12. In this way, each binder post 22 passes through the openings 38 provided in each cover 18 or 20 and also passes through the apertures 14 provided in the forms 12, the binder post 22 thereby securing the forms 12 in place between the covers 18 and 20, as will be described hereinafter in greater detail.

The intermediate section 32 includes an elongated formed and raised portion 40 which projects upwardly and outwardly from the generally planar portion of the intermediate section 32. The raised portion 40 is spaced slightly inwardly of the outer hinge section 34. The raised portion 40 includes a plurality of outwardly extending and downwardly turned locking fingers 42 which are unitary with the raised portion 40. The locking fingers 42 are, like the rest of the cover 18 or 20, unitarily formed therewith. The locking fingers are spaced upwardly from the main surface of the intermediate marginal section 32 at a distance approximately equal to the thickness of one of the flexible binder posts 22. As seen best in FIG. 3, each binder post 22 is removably received by and spaced below the fingers 42 and the upper surface of the intermediate section 32. The downwardly tuned ends of the locking fingers 42 define hooks which substantially secure the flexible binder posts 22 in place in the space provided. The locking fingers 42 are of the same formed plastic material, preferably polypropylene, as the cover 18 or 20, and are sufficiently flexible to permit a binder post to be removably received and secured by the fingers 42. In this way, each binder post 22 may be readily moved in and out of locking engagement with the plurality of fingers 42.

The unitary hinge portion or section 28 defined between the planar cover 24 and the marginal edge portion 26 and intermediate section 34 thereof has a raised section 44 formed along the inner marginal portion of the cover portion 24 and a raised section 46 provided along the inner edge of the marginal edge portion 26, the raised sections 44 and 46 being flexibly and hingedly secured to each other along the narrow elongated living hinge section defined therebetween.

The outer section 30 of the marginal edge portion 26 includes a central raised portion 48 and a peripheral border, generally, 50. The peripheral border 50 includes an outer edge 52 having a plurality of the laterally projecting locking members 54. The central portion 48 is so constructed as to cover and enclose the raised section 44 of the intermediate section 32 of the marginal edge portion 26. The projections 54 are received within a plurality of aligned pockets 56 which are defined on and open outwardly from the raised section 46 of the intermediate section 32. The projections 54 removably engage and cooperate with the pockets 56 to secure the outer section 30 in place over the locking section 36 and the raised section 44 of the intermediate section 32 in order to securely assure attachment of the binder posts 22 with the marginal edge portion even in the unlikely event that the binding parts become disengaged from the locking fingers 42. Therefore, even if the binder post 22 accidently become disengaged from one or more of the locking fingers 42, the cover section 32 substantially assures that the binder posts 22 remain engaged with the covers 18 or 20.

The binder posts 22 are of a known construction and generally comprise a plastic sheath wrapped over a strand of formable metal wire. Although the binder posts 22 are flexible, they generally remain in the position in which they are set although they may be readily moved between a locking position and an unlocked position so the covers 18 and 20 may be readily separated therefrom. Binder posts 22 pass through the apertures 14 in the forms 12 and through the openings 38 provided in the intermediate section 32 of the marginal edge portion 26.

Figure 8:
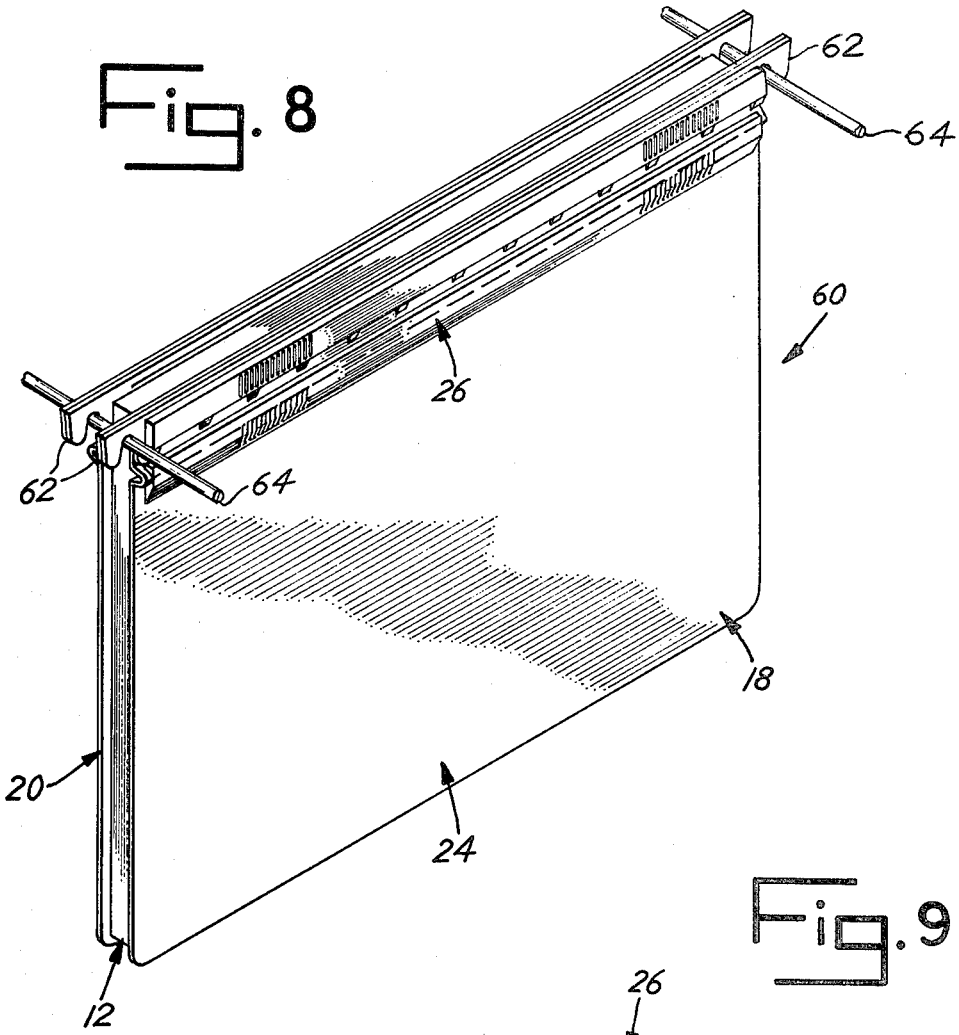
Figure 9:
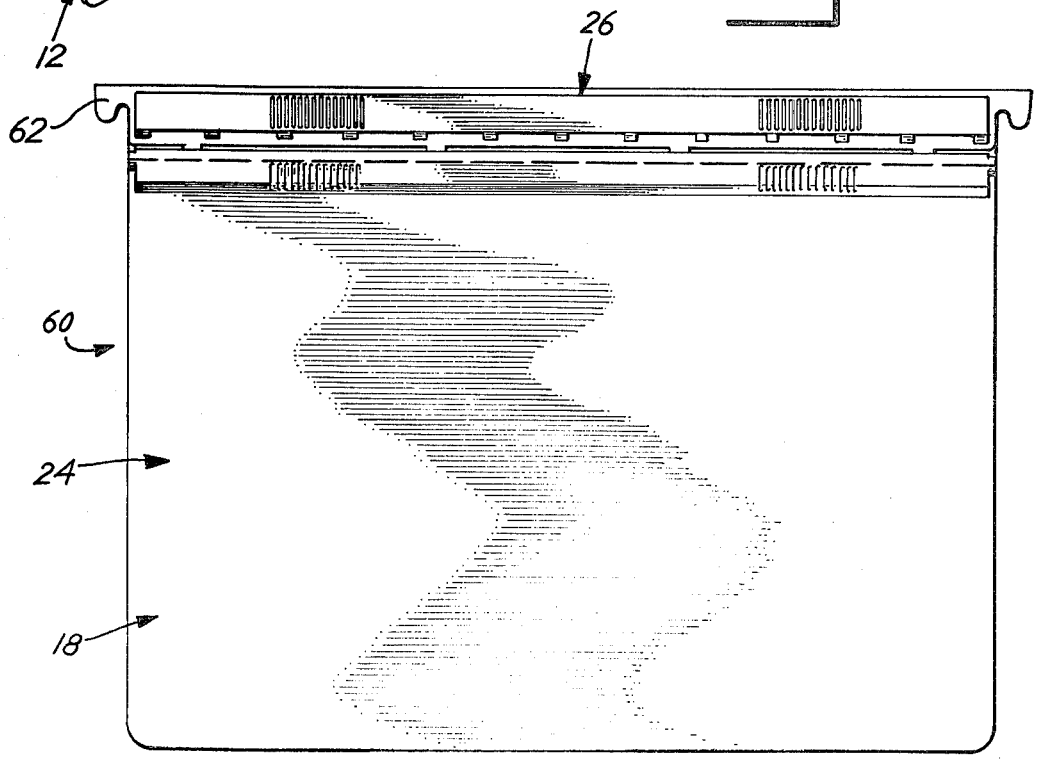
FIG. 9 is a plan view of the alternate embodiment of our binder assembly as illustrated in FIG. 8.

Referring to FIGS. 8 and 9, it is seen that the binder assembly 60 is of substantially the same construction as the binder assembly 10 except that a pair of unitary hooks or hangers 62 project laterally outwardly from the intermediate section 32 and the outer section 30 of each marginal edge portion 26 of each of the covers 16 and 18. These hooks or hangers 62 are received on spaced support rods 64 used in a storage chamber (not shown) used to suspend the binder assembly 10 with forms 12 therein in a substantially upright position.

From the foregoing it is seen that all of the objects previously set forth have been accomplished. In the use of the assembly, it is considered highly advantageous that the covers 18 and 20 are removed from the assembly 10 in order to insert more forms 12. This is accomplished in a very simple way not generally found in the prior art, that is, the covers 18 themselves, need not be moved to an open position, which is generally true with the prior art binders because the locking portions are generally located internally and the cover must be opened. Merely by separating the projections 54 on the outer section 30 from the pockets 56 enables the cover section to be pivoted to the open position and then each binder post 22 may be moved into or out of engagement with the locking fingers 42 provided on the intermediate section 32 of the marginal edge portion 26. Also, it is seen that the binder assembly 10 is only slightly greater in area than the forms 12 themselves. There is ease of loading and unloading as a result of no moving parts, other than the unitary elements themselves, as found in prior art devices. Further advantages of the binder assembly 10 are that there are no sharp metal edges. Polypropylene construction is also very durable and utilizes a long life integral living hinge type of construction.

While in the foregoing there has provided a detailed description of particular embodiments of the present invention, it is to be understood that all equivalents obvious to those having skill in the art are to be included within the scope of the invention as claimed.

What is claimed is:

1. A binder assembly for securing and storing business forms of the type having apertures therein, said assembly comprising first and second cover members and first and second elongated flexible securing means removably received by both of said first and second cover members, said cover members and said securing means being constructed and arranged to removably secure said business forms in position between said cover members, said securing means being constructed and arranged to pass through selected ones of said apertures in said business forms, each of said cover members being unitarily formed and having a cover portion being of a size for substantially covering and for being superimposed over a selected number of secured and stored business forms, each of said cover members also having a contiguous marginal edge portion unitary with said cover portion, spaced openings provided in said edge portion, each of said openings being positioned for alignment with said selected apertures of said forms and being constructed and arranged to receive said elongated flexible securing means, and means defined on and unitary with said marginal portion for removably receiving and securing portions of said flexible securing means, both of said flexible securing means and both of said cover members being of substantially the same construction and defining the only parts of said binder assembly and the only operative parts required for removably securing said forms in place between said cover members with said forms being received by said flexible securing means.

2. The binder assembly of claim 1 wherein each of said cover members includes unitary means for hingedly and unitarily interconnecting said cover portion and said marginal edge portion.

3. The binder assembly of claim 2 wherein each of said cover members is formed of a polypropylene material.

4. The binder assembly of claim 1 wherein each said marginal edge portion further includes a unitary intermediate section having said receiving means thereon and having an outer section unitarily and hingedly secured to said intermediate section.

5. The binder assembly of claim 4 wherein said outer section and said intermediate section include cooperating means for removably securing said cover portion in a closed position to said intermediate section and over said receiving means for further assuring maintenance of the securing relationship between said cover members and said elongated flexible securing means.

6. The binder assembly of claim 1 including means contiguous with said marginal edge portion for suspending each of said binder assemblies during storage.

7. The binder assembly of claim 1 wherein said removable receiving and securing means includes unitarily formed flexible members operatively interconnected to and engaged on said elongated flexible securing means.

8. The binder assembly of claim 7 wherein said removable receiving and securing means comprise a plurality of unitary locking fingers for engaging said flexible securing means in position.

9. The binder assembly of claim 1 wherein said elongated flexible securing means comprises a plastic coated wire means.

* * * * *